US009062415B2

(12) United States Patent
Godsay et al.

(10) Patent No.: US 9,062,415 B2
(45) **Date of Patent: *Jun. 23, 2015**

(54) SYSTEMS AND METHODS FOR MAKING FIBER WEBS

(71) Applicant: Hollingsworth & Vose Company, East Walpole, MA (US)

(72) Inventors: Milind Godsay, Nashua, NH (US); Mark S. Millar, Bolton, MA (US)

(73) Assignee: Hollingsworth & Vose Company, East Walpole, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,667

(22) Filed: May 7, 2014

(65) Prior Publication Data

US 2014/0238629 A1 Aug. 28, 2014

Related U.S. Application Data

(63) Continuation of application No. 13/559,221, filed on Jul. 26, 2012, now Pat. No. 8,753,483.

(60) Provisional application No. 61/512,034, filed on Jul. 27, 2011.

(51) Int. Cl.

| | |
|---|---|
| ***D21F 1/00*** | (2006.01) |
| ***D21F 11/00*** | (2006.01) |
| ***D21F 9/00*** | (2006.01) |
| *D21H 27/30* | (2006.01) |

(52) U.S. Cl.

CPC ..... *D21F 11/00* (2013.01); *D21H 27/30* (2013.01); *D21F 9/00* (2013.01)

(58) Field of Classification Search

None

See application file for complete search history.

(56) References Cited

U.S. PATENT DOCUMENTS

| | | | | | |
|---|---|---|---|---|---|
| 3,997,390 | A | * | 12/1976 | Kankaanpaa | 162/132 |
| 4,240,872 | A | * | 12/1980 | Wahren | 162/344 |
| 4,888,094 | A | | 12/1989 | Weisshuhn et al. | |
| 4,931,357 | A | | 6/1990 | Marshall et al. | |
| 5,011,573 | A | | 4/1991 | Niemi | |
| 5,011,575 | A | | 4/1991 | Keller | |
| 5,064,502 | A | | 11/1991 | Turner | |

(Continued)

FOREIGN PATENT DOCUMENTS

WO WO 92/01112 A1 1/1992

OTHER PUBLICATIONS

International Search Report and Written Opinion for PCT/US2012/037534 mailed on Jul. 27, 2012.

(Continued)

*Primary Examiner* — Mark Halpern

(74) *Attorney, Agent, or Firm* — Wolf, Greenfield & Sacks, P.C.

(57) ABSTRACT

Systems and methods for forming fiber webs, including those suitable for use as filter media and battery separators, are provided. In some embodiments, the systems and methods involve designs which allow improved control of the fiber web forming process. For example, in certain embodiments involving the flowing of more than one fiber mixtures, the amount of mixing of the fiber mixtures may be controlled to produce fiber webs having different structural and/or performance characteristics. In some embodiments, the systems and methods can be used to form fiber webs having a gradient in a property across a portion of, or the entire, thickness of the fiber web.

20 Claims, 3 Drawing Sheets

(56) References Cited

U.S. PATENT DOCUMENTS

| | | | | | |
|---|---|---|---|---|---|
| 5,074,965 | A | * | 12/1991 | Keskiivari et al. | 162/216 |
| 5,082,530 | A | * | 1/1992 | Keskiivari et al. | 162/216 |
| 5,298,126 | A | | 3/1994 | Dahl | |
| 5,645,689 | A | | 7/1997 | Ruf et al. | |
| 5,674,364 | A | | 10/1997 | Pitkajarvi | |
| 6,059,929 | A | | 5/2000 | Dahl | |
| 6,099,692 | A | | 8/2000 | Weisshuhn et al. | |
| 6,190,735 | B1 | | 2/2001 | Radwanski et al. | |
| 6,251,225 | B1 | | 6/2001 | Ruf et al. | |
| 6,764,566 | B1 | | 7/2004 | Griesbach et al. | |
| 8,753,483 | B2 | | 6/2014 | Godsay et al. | |
| 8,758,559 | B2 | | 6/2014 | Vallery | |
| 2002/0060040 | A1 | | 5/2002 | Rulis et al. | |
| 2002/0108732 | A1 | | 8/2002 | Grabsoheid et al. | |
| 2002/0153113 | A1 | | 10/2002 | Ruf et al. | |
| 2003/0032350 | A1 | | 2/2003 | Kajander et al. | |
| 2003/0056918 | A1 | | 3/2003 | Hamalainen et al. | |
| 2003/0159790 | A1 | | 8/2003 | Ruf et al. | |
| 2005/0034827 | A1 | | 2/2005 | Soderberg | |
| 2005/0124250 | A1 | | 6/2005 | Wilson et al. | |
| 2007/0012414 | A1 | | 1/2007 | Kajander et al. | |
| 2008/0093042 | A1 | | 4/2008 | Skoog et al. | |
| 2008/0110588 | A1 | | 5/2008 | Lepomaki et al. | |
| 2009/0020251 | A1 | | 1/2009 | Soderberg | |
| 2010/0187712 | A1 | | 7/2010 | Gupta et al. | |
| 2010/0319543 | A1 | | 12/2010 | Witsch et al. | |
| 2012/0193056 | A1 | | 8/2012 | Gupta et al. | |
| 2012/0312487 | A1 | | 12/2012 | Guimond et al. | |
| 2013/0009335 | A1 | | 1/2013 | Guimond et al. | |
| 2013/0025806 | A1 | | 1/2013 | Vallery | |
| 2013/0025809 | A1 | | 1/2013 | Godsay et al. | |

OTHER PUBLICATIONS

International Preliminary Report on Patentability for PCT/US2012/037534 mailed on Nov. 21, 2013.
International Search Report and Written Opinion for PCT/US2012/48291 mailed on Sep. 20, 2012.
International Preliminary Report on Patentability for PCT/US2012/48291 mailed on Feb. 6, 2014.
International Search Report and Written Opinion for PCT/US2012/48301 mailed on Sep. 20, 2012.
International Preliminary Report on Patentability for PCT/US2012/48301 mailed on Feb. 6, 2014.
Extended European Search Report for EP12817456.2 mailed Feb. 5, 2015.

* cited by examiner

SYSTEMS AND METHODS FOR MAKING FIBER WEBS

RELATED APPLICATIONS

This application is a continuation of U.S. application Ser. No. 13/559,221, filed Jul. 26, 2012, which claims priority to U.S. Provisional Application No. 61/512,034, filed Jul. 27, 2011, which are incorporated herein by reference their entireties.

FIELD OF INVENTION

The present invention relates generally to systems and methods for forming fiber webs, including fiber webs that are suitable for use as filter media and battery separators.

BACKGROUND

Fiber webs are used in a variety of applications, and in some embodiments can be used as filter media and battery separators. Generally, fiber webs can be formed of one or more fiber types including glass fibers, synthetic fibers, cellulose fibers, and binder fibers.

Fiber webs can be formed by a variety of processes. In some embodiments, fiber webs are formed by a wet laid process. A wet laid process may involve the use of similar equipment as a conventional papermaking process, which may include, for example, a hydropulper, a former or a headbox, a dryer, and an optional converter. Fibers may be collected on a screen or wire at an appropriate rate using any suitable machine such as a fourdrinier, a rotoformer, a cylinder, a pressure former, or an inclined wire fourdrinier. Although such processes may be used to form a variety of different fiber webs, improvements in the systems and methods for forming fiber webs would be beneficial and would find application in a number of different fields.

SUMMARY OF THE INVENTION

Systems and methods for forming fiber webs, including those suitable for use as filter media, are provided.

In one set of embodiments, a system for forming a fiber web is provide. The system includes a flow distributor configured to dispense a fiber mixture and a flow zone positioned downstream of the flow distributor and configured to receive the fiber mixture. The system further includes a first fiber web forming zone, at least a part of which is positioned downstream of the flow zone, the first fiber web forming zone configured to receive and collect fibers from the fiber mixture. The first fiber web forming zone comprises a first forming wire portion positioned at a first angle with respect to the horizontal. The system also includes a second fiber web forming zone positioned downstream of the first fiber web forming zone, wherein the second fiber web forming zone comprises a second forming wire portion positioned at a second angle with respect to the horizontal, and wherein the first angle is different from the second angle. The system further includes a top surface enclosing at least a portion of the first fiber web forming zone. The system is configured as a pressure former.

In another set of embodiments, a method of forming a fiber web is provided. The method includes introducing a fiber mixture into a flow zone of a system for forming a fiber web, wherein the system comprises a pressure former. The method involves collecting fibers from the fiber mixture downstream of the flow zone in a first fiber web forming zone, wherein the first fiber web forming zone comprises a first forming wire portion positioned at a first angle with respect to the horizontal. The method further involves transporting the fibers to a second fiber web forming zone positioned downstream of the first fiber web forming zone, wherein the second fiber web forming zone comprises a second forming wire portion positioned at a second angle with respect to the horizontal, and wherein the first angle is different from the second angle. The method involves forming a fiber web comprising fibers from the fiber mixture.

Other aspects, embodiments, advantages and features of the invention will become apparent from the following detailed description.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Systems and methods for forming fiber webs, including those suitable for use as filter media and battery separators, are provided. In some embodiments, the systems and methods allow for improved control of the fiber web forming process. For example, in certain embodiments involving the flowing of more than one fiber mixtures in a system, the amount of mixing of the fiber mixtures may be controlled to produce fiber webs having different structural and/or performance characteristics. In some embodiments, the systems and methods described herein can be used to form fiber webs having a gradient in a property across a portion of, or the entire, thickness of the fiber web.

Figure 1:
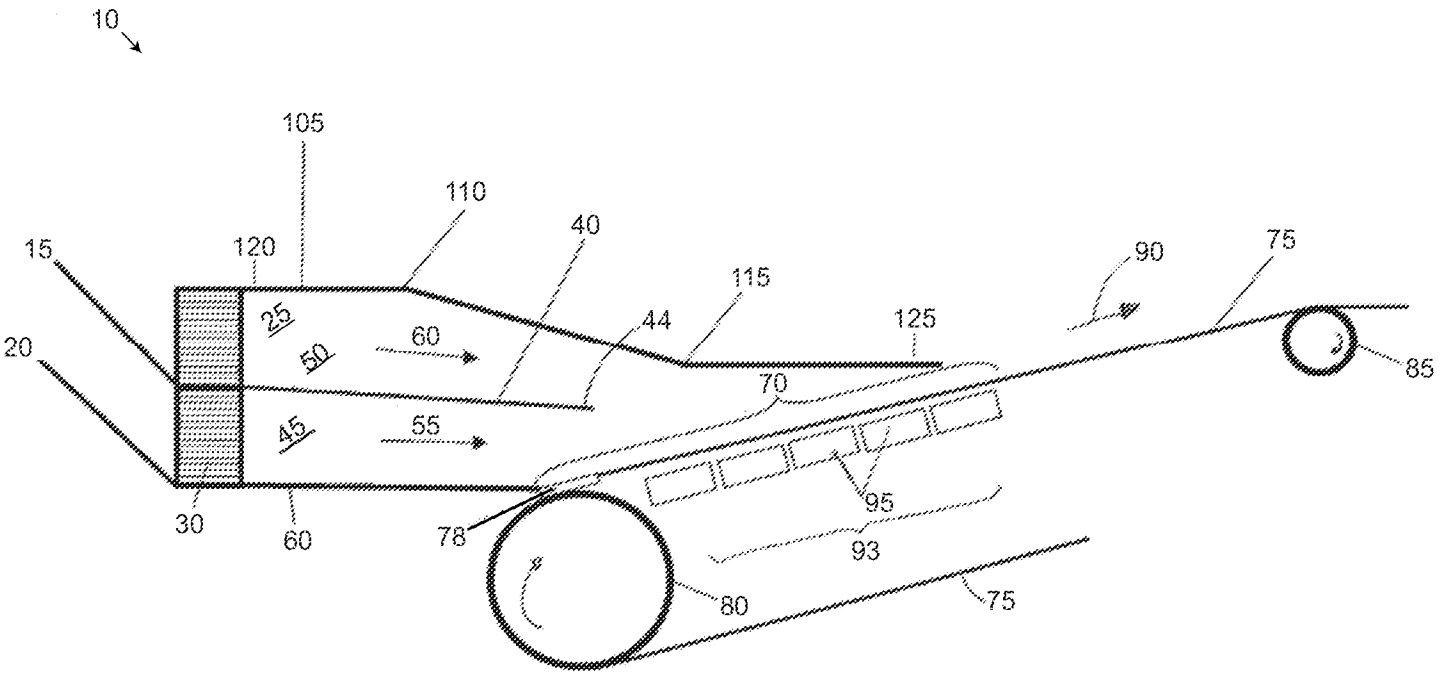
FIG. 1 is a schematic diagram showing a system for forming a fiber web according to one set of embodiments.

An example of a system for forming a fiber web using a wet laid process is shown in the embodiment illustrated in FIG. 1. As shown illustratively in FIG. 1, a system 10 may include flow distributors 15 and 20 (e.g., headboxes) configured to dispense one or more fiber mixtures into a flow zone 25 positioned downstream of the one or more flow distributors. Although two distributors are shown in FIG. 1, in some embodiments only a single flow distributor may be present; in other embodiments, three or more flow distributors may be present (e.g., for introducing three or more fiber mixtures into the system). In some embodiments, a distributor block 30 may be positioned between the one or more flow distributors and the flow zone. The distributor block may help to evenly distribute the one or more fiber mixtures across the width of the flow zone upon the mixture(s) entering the flow zone. Different types of distributor blocks are known in the art and can be used in the systems described herein. Alternatively, in some embodiments, the system need not include a distributor block.

As shown in the exemplary embodiment of FIG. 1, system 10 may include a lamella 40 positioned in the flow zone. The lamella may be used as a partition to divide the flow zone into a lower portion 45 and an upper portion 50 (or into additional portions when multiple lamellas are present, as described in more detail below). In certain embodiments, the lamella can be used to separate a first fiber mixture flowing in the lower portion of the flow zone from a second fiber mixture flowing in the upper portion of the flow zone. For example, a first fiber mixture dispensed from flow distributor 20 into the lower portion 45 of the flow zone may be separated from a second fiber mixture dispensed from flow distributor 15 into the upper portion 50 of the flow zone until the mixtures reach a downstream end 44 of the lamella, after which the first and second fiber mixtures are allowed to meet. The first and second fiber mixtures generally flow in the lower and upper portions of the flow zone in a downstream direction (e.g., in the direction of arrows 55 and 60, respectively). The flow profile of the fluids in the lower and upper portions of the flow zone can be altered, in part, by choosing a lamella with appropriate features, as described in more detail below.

A fiber web forming zone 70 may be configured to receive the first and second fiber mixtures. The fiber web forming zone is generally positioned downstream of the flow zone, although it may include portions of the flow zone. For example, in some embodiments, the fiber web forming zone may include a portion of the lower portion of the flow zone, as well as apron 78 which may be used to connect a bottom surface portion 100 of the flow zone to a forming wire 75. The forming wire may be a perforated support used to receive and collect the fibers as the forming wire rotates about a breast roll 80 and a couch roll 85. As such, the forming wire may be used to transport the fibers collected from the fiber mixtures in the general direction of arrow 90 for further downstream processing, while allowing liquid from the fiber mixtures to be removed by gravity and/or by a dewatering system 93. Any suitable dewatering system can be used, including a series of vacuum boxes 95. The forming wire may be positioned at an incline with respect to the horizontal as shown in FIG. 1, although other positions are also possible, including having the forming wire at a horizontal position itself. In some embodiments, the fiber web forming zone is entirely downstream of the flow zone.

As shown illustratively in FIG. 1, in some embodiments system 10 may be a substantially closed system in which the flow zone and fiber web forming zone are substantially enclosed by a top surface 105 and a bottom surface formed by bottom surface portion 100 and forming wire 75. The top surface may include one or more joints 110 and 115, which may be used to shape the top surface and affect the flow profile of one or more fiber mixtures flowing in the system. It should be appreciated that configurations other than the ones shown in FIG. 1 are possible. For example, in some embodiments the top surface does not include any joints 110 or 115. In other embodiments, bottom surface portion 100 may include one or more joints. Additionally, although surfaces 100 and 105 are shown as flat portions of material, in other embodiments these surfaces may be curved or have any other suitable shape. Furthermore, one or more portions of the bottom and/or top surface may be horizontal, positioned at an incline with respect to the horizontal, or positioned at a decline with respect to the horizontal.

In certain embodiments, system 10 may be a pressure former. System 10 may be a closed system and the pressure of the one or more fiber mixtures in the flow zone may be maintained and/or controlled by, for example, controlling the pressure or volume of the one or more fiber mixtures introduced into the flow zone and controlling the distance between the top surface and the bottom surface (e.g., the void volume in the flow zone and fiber web forming zone), as described in more detail below.

In some cases, system 10 is an open system and does not include a top surface 110. In other cases, system 10 does not include a bottom surface portion 100 but instead, a fiber mixture flows directly onto a forming wire. Other configurations are also possible.

The size of system 10, which may be controlled in part by choosing appropriate dimensions for the top and/or bottom surfaces of the system, may vary as desired. For example, in some embodiments, the length of the top surface may range from about 300 mm to about 2,000 mm (e.g., between about 300 mm to about 1,000 mm, between about 600 mm to about 1,700 mm, or between about 1,000 mm to about 2,000 mm). In some embodiments, the length of the top surface may be, for example, greater than about 300 mm, greater than about 600 mm, greater than about 1,000 mm, greater than about 1,400 mm, or greater than about 1,700 mm. In other embodiments, the length of the top surface may be, for example, less than about 2,000 mm, less than about 1,700 mm, less than about 1,400 mm, less than about 1,000 mm, or less than about 600 mm. Other lengths are also possible. In some embodiments, the length of the top surface is determined by measuring the absolute distance between the two ends of the top surface. In other embodiments, the length of the top surface is determined by measuring the sum of the lengths of the surface portions of the top surface (including the lengths of each portion of the top surface between any joints).

The length of bottom surface portion 100 may range from, for example, about 100 mm to about 2,000 mm (e.g., between about 100 mm to about 700 mm, between about 300 mm to about 1,000 mm, between about 300 mm to about 800 mm, or between about 1,000 mm and about 2,000 mm). In some embodiments, the length of the bottom surface may be, for example, greater than about 100 mm, greater than about 300 mm, greater than about 500 mm, greater than about 700 mm, or greater than about 1,200 mm. In other embodiments, the length of the bottom surface may be, for example, less than about 1,700, less than about 1,300, less than about 1,000 mm, less than about 700 mm, less than about 500 mm, or less than about 300 mm. Other lengths are also possible. In some embodiments, the length of the bottom surface portion is determined by measuring the absolute distance between the two ends of the bottom surface portion. In other embodiments, the length of the bottom surface portion is determined by measuring the sum of the lengths of the bottom surface portions between any joints.

The width of the top and bottom surfaces may also vary. In some cases, the average width of the top or bottom surface is between about 500 mm and about 12,500 mm (e.g., between about 6,000 mm and about 12,500 mm, between about 500 mm and about 6,000 mm, or between about 3,000 and about 9,000 mm). In some embodiments, the average width of the top or bottom surface may be, for example, greater than about 500 mm, greater than about 1,000 mm, greater than about 3,000 mm, greater than about 6,000 mm, or greater than about 9,000 mm. In other embodiments, the width of the top or bottom surface may be, for example, less than about 12,500 mm, less than about 9,000 mm, less than about 6,000 mm, less than about 3,000 mm, or less than about 1,000 mm. Other average widths of the top or bottom surfaces are also possible.

The width of the top and bottom surfaces may be substantially uniform across the length of the surface, or in other embodiments, may vary along the length of the surface. For example, in some cases, an upstream portion 120 of the top surface may be wider than a downstream end 125 of the top surface, and may optionally taper from the upstream to the downstream portions. The bottom surface may have a configuration similar to that the top surface, or may different from that other top surface. Other configurations are also possible.

The size of system 10 may also be controlled in part by choosing appropriate distances between the top and bottom surfaces of the system and/or an appropriate height of the distributor block. Generally, a distance between the top and bottom surfaces at the upstream end of flow zone, and/or a height of a distributor block, may be between about 10 mm and about 2,000 mm (e.g., between about 10 mm and about 500 mm, between about 500 mm and about 1,000 mm, or between about 1,000 mm and about 2,000 mm). In some cases, the distance between the top and bottom surfaces at the upstream end of flow zone, and/or a height of a distributor block, may be greater than about 10 mm, greater than about 200 mm, greater than about 500 mm, greater than about 1,000 mm, greater than about 1,500 mm. In other cases, the distance between the top and bottom surfaces at the upstream end of flow zone, and/or a height of a distributor block, may be less than about 2,000 mm, less than about 1,500 mm, less than about 1,000 mm, less than about 500 mm, or less than about 200 mm. Other values are also possible.

The top and bottom surfaces can be made of any suitable material. Generally, the materials for top and bottom surfaces are chosen for their strength and anti-corrosion properties. Examples of suitable materials may include metals (e.g., stainless steel, composite steels), polymers (e.g., soft latex, rubbers, high density polyethylene, epoxy, vinylester, polyester), fiber-reinforced polymers (e.g., using fiberglass, carbon, or aramid fibers), ceramics, and combinations thereof. The top and bottom surfaces may be formed of a single piece of material, or may be formed by combining two or more pieces of materials.

It should be appreciated that the components in system 10 are not limiting and that in some embodiments, certain components shown in FIG. 1 need not be present in a system, and in other embodiments, other components may optionally be present. For example, in some embodiments, system 10 further includes a secondary flow distributor (not shown) positioned downstream of fiber web forming zone 70. The secondary flow distributor may be used to position one or more additional layers on top of the fiber web formed using the system shown in FIG. 1. The secondary flow distributor may be positioned so that forming wire 75 carrying the drained fibers from fiber web forming zone 70 passes underneath the secondary flow distributor. One or more secondary fiber mixtures can then be laid on top of, and then drained through, the already formed fiber web. The water can then be removed by a secondary dewatering system resulting in a combined web including fibers from the system shown in FIG. 1 as one or more bottom layers, and fibers from the secondary flow distributor as a top layer. The resulting fiber web can be dried by various methods such as by passing over a series of dryer cans. The dried web can then be optionally wound into rolls at a reel.

Optionally, one or more secondary flow distributors and/or other components can be used to add one or more additives to a fiber web. A secondary flow distributor may be used to introduce, for example, a binder and/or other additives to a pre-formed fiber web. In one such embodiment, as a pre-formed fiber web is passed along the forming wire, a binder resin (which may be in the form of one or more emulsions) may be added to the fiber web. The binder resin may be pulled through the fiber web using dewatering system 93, or a separate dewatering system further downstream. In certain embodiments, one or more of the components included in the binder resin may be diluted with softened water and pumped into the fiber web. Other systems and methods for introducing additives to a fiber web are also possible.

As described above, a lamella may be positioned in the flow zone to partition the flow zone into at least an upper portion and a bottom portion. Although a single lamella is shown in the system illustrated in FIG. 1, in other embodiments the flow zone may not include a lamella positioned therein, or the flow zone may include more than one lamella for separating three or more fiber mixtures. In some such embodiments, the flow zone may be separated into three, four, or more distinct portions, each of which may contain a different fiber mixture. The lamella may be positioned in any suitable position within the flow zone, and may vary depending on relative volumes of the fiber mixtures in the upper and lower portions of the flow zone. For example, although FIG. 1 shows the lamella being positioned at the center of the distributor block to allow substantially equal volumes and/or flow velocities of the fiber mixtures in each of the upper and lower portions of the flow zone, in other embodiments the lamella may be positioned higher or lower with respect to the distributor block to allow a larger or smaller portion of one fiber mixture in the flow zone relative to the other. Furthermore, although FIG. 1 shows that the lamella is positioned at a slight decline with respect to the horizontal, in other embodiments the lamella may be substantially horizontal, or positioned at an incline with respect to the horizontal. Other positions of the lamella in the flow zone are also possible.

A lamella may be attached to a portion of a system for forming a fiber web using any suitable attachment technique. In some embodiments, a lamella is attached directly to a distributor block. In other embodiments, a lamella is attached to a threaded rod positioned vertically within a portion of the flow zone. In certain embodiments, attachment involves the use of adhesives, fasteners, metallic banding systems, railing mechanisms, or other support mechanisms. Other attachment mechanisms are also possible.

The lamella may have any suitable dimensions. In some embodiments, the lamella has a length of, for example, between about 1 mm and about 2,000 mm (e.g., between about 100 mm and about 500 mm, between about 100 mm and about 1,000 mm, or between about 1,000 mm and about 2,000 mm). The length of the lamella may be, for example, greater than about 1 mm, greater than about 100 mm, greater than about 300 mm, greater than about 500 mm, or greater than about 1,000 mm. In other cases, the length of the lamella is less than about 2,000 mm, less than about 1,000 mm, less than about 500 mm, less than about 300 mm, or less than about 100 mm. The length of the lamella is determined by measuring the absolute length of the lamella. In some instances, the lamella extends from the distributor block to the dewatering system (e.g., an upstream-most vacuum box). In other instances, the lamella extends from the distributor block until the downstream end of the top surface. Other configurations are also possible.

The width of the lamella typically extends the width of the flow zone, although other configurations are also possible.

The thickness of the lamella can also vary. For example, the average thickness of the lamella may be between about 1/16" to about 4" (e.g., between about 1/16" to about 1", between about 1" to about 4", between about 1/8" to about 1/4", or between about 1/8" to about 1/6"). In some cases, the average thickness of the lamella is greater than about 1/8", greater than about 1/6", greater than about 1/4", greater than about 1/2", greater than about 1", or greater than about 2". In other cases, the average thickness of the lamella is less than about 2", less than about 1", less than about ½", less than about ¼", less than about ⅙", or less than about ⅛". In yet other embodiments, the thickness of the lamella can vary along the length of the lamella. For example, the thickness of the lamella may taper along its length (e.g., from about ¼" to about ⅛"). Other thicknesses are also possible.

The lamella can be made of any suitable material. Generally, the materials for the lamella are chosen for their strength and anti-corrosion properties. Examples of suitable materials may include metals (e.g., stainless steel, composite steels), polymers (e.g., soft latex, rubbers, high density polyethylene, epoxy, vinylester, polyester), fiber-reinforced polymers (e.g., using fiberglass, carbon, or aramid fibers), ceramics, and combinations thereof. The lamella may be formed of a single piece of material, or may be formed by combining two or more pieces of materials.

In some existing systems, the systems may be designed so that formation of the fiber web is relatively fast upon reaching the fiber web forming zone. As the fiber mixture is transported across the fiber web forming zone, the fiber web may be formed relatively fast by quickly removing the solvent from the fiber mixture. In some such embodiments, as the fiber mixture exits a downstream end of the top surface in the fiber web forming zone, the fiber web may be substantially formed in the sense that the fibers in the fiber mixture have a particular orientation with respect to one another (e.g., in the x, y and z directions), and this orientation does not change substantially as the fiber mixture undergoes further processing (e.g., downstream removal of a solvent from the fiber mixture or web). Fast formation of the fiber web may be desirable in some cases, such as when a distinct separation between layers of the fiber web is desired. In certain embodiments described herein, however, the systems and methods may include features that promote a relatively slower fiber web formation process, which may allow more time for mixing between fiber mixtures, and more control of the amount of intermixing between fibers in the fiber mixtures.

Although the degree of formation of a fiber web is generally characterized by the orientation of the fibers in the fiber web, an indication of the relative degree of formation may be determined, at least in part, by the solid content in the fiber mixture at a location within the fiber web forming system (e.g., at the downstream end of the top surface within the fiber web forming zone). As shown illustratively in FIG. 1, as the fiber mixture exits downstream end 125 of the top surface, solvent is being removed from the fiber mixture using dewatering system 93. In some systems, such as in system 10 of FIG. 1, a fiber mixture that exits the downstream end of the top surface (so that the fiber mixture is no longer enclosed by the top surface) may have a solid content of about 18 wt % to about 35 wt %, (or even higher). In other words, about 18-35 wt % of the fiber mixture is in the form of solids such as fibers, and the remaining portion of the fiber mixture is in the form of liquids. A relatively high amount of solids in the fiber mixture typically indicates that the fiber web is formed to a greater extent, and that the orientation of the fibers in the fiber mixture or web is relatively more set such that the orientation does not change significantly as the fiber mixture undergoes further processing, compared to a low amount of solids in the fiber mixture measured at the same position within the system.

In certain embodiments described herein, the systems and methods described herein for forming a fiber web may involve slower formation of the fiber web across a fiber web forming zone, or across multiple fiber web forming zones, compared to that in certain conventional systems. For example, a system described herein may include features such that as the fiber mixture exits the downstream end of the top surface, it has less than about 35 wt % solids (e.g., less than about 32 wt %, 30 wt %, 28 wt %, 26 wt %, 24 wt %, 22 wt %, 20 wt %, 18 wt %, or other wt % solids described herein), and only reaches about 35 wt % solids (e.g., about 32 wt %, 30 wt %, 28 wt %, 26 wt %, 24 wt %, 22 wt %, 20 wt %, 18 wt %, or other wt % solids described herein) after additional liquid has been removed further downstream of the downstream end of the top surface. Other ranges of wt % solids are provided below. Additionally or alternatively, in some embodiments system 10 of FIG. 1 may include more than one fiber web forming zones, wherein the fiber web forming zones are positioned at different angles with respect to the horizontal. In some instances, these and/or other features described herein can allow for greater control of the formation of fiber webs having one or more gradients across all or portions of the thickness of the fiber web. Additionally or alternatively, the features in the system may allow the formation of fiber webs at relatively higher throughputs than in certain conventional systems without the fiber webs losing certain desired structural and/or performance characteristics.

Figure 2:
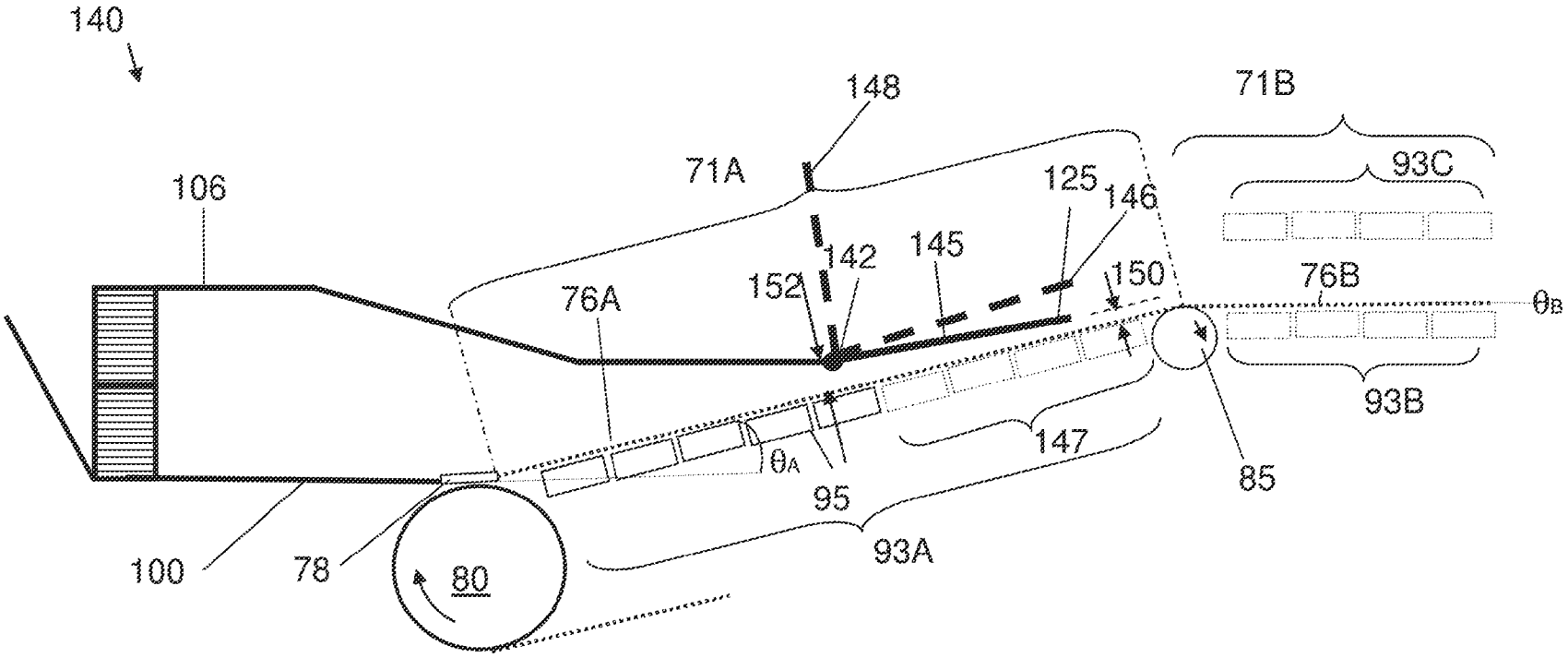
FIG. 2 is a schematic diagram showing a system for forming a fiber web that includes multiple fiber web forming zones according to one set of embodiments.

An example of a system that may include some of the advantages described herein is shown in the embodiment illustrated in FIG. 2. As shown illustratively in FIG. 2, a system 140 may include a top surface 106 having an extension 145, resulting in the top surface having a relatively longer length than the top surface shown in system 10 of FIG. 1. System 140 may also include a first fiber web forming zone 71A that is extended in length compared to the fiber web forming zone shown in FIG. 1. In some cases, a larger portion (e.g., length) of the fiber web forming zone may be enclosed by the top surface compared to the fiber web forming zone shown in FIG. 1. System 140 may also include a second fiber web forming zone 71B that is positioned downstream of the first fiber web forming zone. In some cases, the second fiber web forming zone may not be enclosed by a top surface. The system may also include an extended forming wire 76, an extended dewatering system 93A, and optional dewatering systems 93B and 93C.

In some embodiments, the features of the systems and methods described herein may be applied to pressure formers. In other embodiments, the features of the systems and methods described herein may be applied to other fiber web forming systems.

As shown illustratively in FIG. 2, forming wire 76 may include a first forming wire portion 76A that is positioned at first fiber web forming zone 71A, and a second forming wire portion 76B that may be positioned at second fiber web forming zone 71B. The first forming wire portion may be positioned at a first angle $\theta_A$ with respect to the horizontal, and the second forming wire portion may be positioned at a second angle $\theta_B$ with respect to the horizontal. In some instances, first angle $\theta_A$ is different from second angle $\theta_B$, and as shown illustratively in FIG. 2, the first angle may be greater than the second angle. The first angle of the first forming wire portion may be, for example, between 0° and 90° greater than the second angle. For example, the first angle may be at least 1° greater, at least 2° greater, at least 3° greater, at least 5° greater, at least 10° greater, at least 15° greater, at least 20° greater, at least 30° greater, at least 40° greater, at least 50° greater, at least 60° greater, at least 70° greater, or at least 80° greater than the second angle. In other embodiments, the first angle may be less than the second angle. The first angle of the first forming wire portion may be, for example, between 0° and 90° less than the second angle. For example, the first angle may be at least 1° less, at least 2° less, at least 3° less, at least 5° less, at least 10° less, at least 15° less, at least 20° less, at least 30° less, at least 40° less, at least 50° less, at least 60° less, at least 70° less, or at least 80° less than the second angle. Other differences in angles of different forming wire portions are also possible.

In some cases, the positioning of the second forming wire portion at an angle that is less than that of the first angle may prevent or reduce the likelihood of portions of the fiber mixture falling back on itself as it travels further downstream. Moreover, the presence of a second forming wire portion that is positioned at a different angle with respect to the first forming wire portion may increase the length of the fiber web forming zone(s), and may allow a longer time for fiber web formation. In some embodiments, these and/or other features to the system may lead to greater control of mixing of fibers during the fiber web formation process. For example, in some embodiments, by extending the length of the fiber web forming zone(s) and/or the number of fiber web forming zones, the orientation of the fibers can be manipulated even after the fiber mixture exits a downstream end of the top surface (e.g., using one or more dewatering systems, as described in more detail below). In some embodiments, the fibers in the fiber mixture, as the fiber mixture exits a downstream end of the top surface (e.g., at the first fiber web forming zone), may have a first orientation, and the fibers in the fiber mixture or fiber web at the second fiber web forming zone may be manipulated to have a second orientation different from that of the first orientation. For instance, the first orientation may include relatively little intermixing between two different fibers or fiber mixtures, and the second orientation may include relatively more intermixing between two different fibers or fiber mixtures. In some cases, the fibers in the fiber mixture or fiber web have a second, different orientation after being transported past a second dewatering associated with a second fiber web forming zone. The second dewatering system may be used to manipulate the fiber orientation, as described herein.

The angle at which the first forming wire portion is positioned relative to the horizontal may vary. For example, first angle $\theta_A$ may vary between 0° and about 90° (e.g., between about 0° and about 5°, between about 5° and about 20°, between about 20° and about 40°, or between about 40° and about 90°). In some embodiments, first angle $\theta_A$ is greater than or equal to about 0°, greater than or equal to about 3°, greater than or equal to about 5°, greater than or equal to about 10°, greater than or equal to about 15°, greater than or equal to about 20°, greater than or equal to about 30°, greater than or equal to about 45°, greater than or equal to about 60°, or greater than or equal to about 75°. In other embodiments, the angle at which the first forming wire portion is positioned is less than about 90°, less than about 75°, less than about 60°, less than about 45°, less than about 30°, less than about 20°, less than about 15°, less than about 10°, or less than about 5°. Other angles are also possible. In many embodiments, the first forming wire portion is positioned at an incline; however, in some embodiments, the first forming wire portion is not inclined but is substantially horizontal.

The second angle of the second forming wire portion may be positioned at any suitable angle with respect to the horizontal. In some embodiments, the second angle is within about 45°, within about 30°, within about 20°, within about 10°, within about 5°, within about 4°, within about 3°, within about 2°, or within about 1° above or below the horizontal. In some cases, the second forming wire portion is positioned substantially horizontal. A forming wire portion positioned at a + angle refers to one positioned on an incline with respect to the horizontal, and a forming wire portion positioned at a − angle refers to one on a decline with respect to the horizontal. Other angles are also possible.

Forming wire 76, which may extend past couch roll 85, may have any suitable length. The length of the forming wire from the upstream end of the wire (e.g., near breast roll 80) to the downstream end of the wire may be, for example, between about 2 m and 20 m (e.g., between about 2 m and about 5 m, between about 5 m and about 10 m, or between about 10 m and about 20 m). In some embodiments, the length of the forming wire is greater than or equal to about 2 m, greater than or equal to about 4 m, greater than or equal to about 6 m, greater than or equal to about 8 m, greater than or equal to about 10 m, or greater than or equal to about 15 m. In certain embodiments, the length of the forming wire is less than about 20 m, less than about 15 m, less than about 10 m, less than about 8 m, less than about 6 m, or less than about 4 m. Other lengths are also possible. First forming wire portion 76A, which is positioned at a first angle $\theta_A$, may also have any suitable length. The length of the first forming wire portion may be, for example, between about 2 m and 20 m (e.g., between about 2 m and about 5 m, between about 5 m and about 10 m, or between about 10 m and about 20 m). In some embodiments, the length of the first forming wire portion is greater than or equal to about 2 m, greater than or equal to about 4 m, greater than or equal to about 6 m, greater than or equal to about 8 m, greater than or equal to about 10 m, or greater than or equal to about 15 m. In certain embodiments, the length of the first forming wire portion is less than about 20 m, less than about 15 m, less than about 10 m, less than about 8 m, less than about 6 m, or less than about 4 m. Other lengths are also possible.

Second forming wire portion 76B, which is positioned at a second angle $\theta_B$, and if present in the system, may also have any suitable length. The length of the second forming wire portion may be, for example, between about 2 m and 20 m (e.g., between about 2 m and about 5 m, between about 5 m and about 10 m, or between about 10 m and about 20 m). In some embodiments, the length of the second forming wire portion is greater than or equal to about 2 m, greater than or equal to about 4 m, greater than or equal to about 6 m, greater than or equal to about 8 m, greater than or equal to about 10 m, or greater than or equal to about 15 m. In certain embodiments, the length of the second forming wire portion is less than about 20 m, less than about 15 m, less than about 10 m, less than about 8 m, less than about 6 m, or less than about 4 m. Other lengths are also possible.

It should be appreciated that while in some embodiments, e.g., as shown illustratively in FIG. 2, forming wire portions (e.g., first and second forming wire portions) are part of the same forming wire, in other embodiments, the forming wire portions may be part of separate forming wires. For example, in some cases, a first forming wire portion may be part of a first (e.g., upstream) forming wire. The preformed web or fiber mixture from the upstream forming wire may then be transported onto a second forming wire portion, which may be part of a second, separate (e.g., downstream) forming wire. In other embodiments, the preformed web or fiber mixture from the upstream forming wire may be transported onto other suitable secondary surfaces. Other configurations are also possible.

A system for forming a fiber web may include a top surface that extends to various lengths along a bottom surface (e.g., a forming wire or a portion thereof) of the system. For example, a top surface may have a length that extends at least 40%, at least 45%, at least 50%, at least 55%, at least 60%, at least 65%, at least 70%, at least 75%, at least 80%, at least 85%, at least 90%, at least 95%, or at least 100% of the length of the bottom surface. Other values are also possible.

As shown illustratively in FIG. 2, system 140 may include an extended dewatering system 93A. The dewatering system may be positioned on an incline or it may be horizontal. The extended dewatering system may include additional vacuum boxes 147 that are positioned up to or past the downstream end of the top surface. As described herein, an extended dewatering system may allow for an extended fiber web forming zone 71A. In some embodiments, an extended fiber web forming zone allows for more liquid from a fiber mixture to be removed after it exits the downstream end of the top surface. As such, a fiber mixture exiting the downstream end of the top surface may have a solid content that is relatively less compared to that in certain conventional systems which do not include an extended dewatering system and/or other features of system 140 described herein.

FIG. 2 also shows an optional dewatering system 93B that is positioned below a second forming wire portion 76B and an optional dewatering system 93C that is positioned above the second forming wire portion. Any suitable dewatering system can be used, such as vacuum boxes, driers, heaters, foils, and combinations thereof. It should be appreciated that other configurations are possible, and that in some embodiments, optional dewatering systems 93B and/or 93C may be positioned upstream of couch roll 85. In certain embodiments, a combination of dewatering systems 93B and/or 93C may be positioned both upstream and downstream of the couch roll. Furthermore, although FIG. 2 shows both dewatering systems being positioned along a horizontal portion of the second forming wire portion, one or both dewatering systems may be positioned along an inclined portion of the forming wire in other embodiments.

By decoupling dewatering systems 93B and/or 93C from dewatering system 93A, finer control of the drying process and the properties of the fiber web may be achieved. In some embodiments, dewatering systems 93B and/or 93C can be used to control the presence or absence of a gradient, or the type of a gradient, in the fiber web. For example, in some embodiments, a top layer of the fiber web may include relatively fine fibers, where the fine fibers have a tendency to be pulled through the entire web (and removed from the web) if the web was dried using strong vacuum boxes as part of dewatering systems 93A and/or 93B. In some such embodiments, dewatering system 93C, which is positioned facing a top side of the fiber web, may be used to remove a liquid from the fiber web. Dewatering system 93C may be used to limit the amount of intermixing between fibers in the fiber web by, for example, pulling the liquid from the top layer upwards to reduce the amount of fibers from the fiber web falling into the inner or lower portions of the fiber web. In embodiments in which intermixing between fibers is desired, however, dewatering system 93B may be used to pull fibers from an upper layer into the inner portions of the fiber web.

In some embodiments, both dewatering systems 93C and 93B may be used simultaneously to remove liquid from a fiber web. The dewatering systems may be operated at the same level, or one may be operated to have a greater water removing ability than the other. For example, dewatering system 93C may be used to remove a majority of the solvent from the fiber web, and dewatering system 93B may be used to pull some fibers from the upper layer down into the inner portions of the fiber web. The strength of dewatering system 93B may be controlled to vary the amount of fiber intermixing.

In other embodiments, dewatering systems 93C and 93B may be positioned in series. For example, a first dewatering system may be used to remove solvent from a top side of a fiber web, and a second dewatering system downstream of the first dewatering system may be used to remove solvent from a bottom side (or top side) of the fiber web. Other configurations of dewatering systems are also possible.

It should be appreciated that in other embodiments, dewatering systems 93B and 93C need not be present.

Where dewatering systems 93B and/or 93C are present, one or both may be different from dewatering system 93A. For example, while dewatering system 93A may include a series of vacuum boxes, dewatering system 93B and/or 93C may include a drier or a heater. In other embodiments, however, dewatering systems 93B and/or 93C may be the same as that of dewatering system 93A.

The length of a dewatering system (e.g., dewatering systems 93A, 93B, or 93C) may vary. In some embodiments, the length of a dewatering system as measured between the edge of an upstream-most portion of the dewatering system to the downstream-most portion of the dewatering system may be, for example, between about 0.5 m and 20 m (e.g., between about 0.5 m and about 5 m, between about 2 m and about 10 m, between about 3 m and about 10 m, between about 5 m and about 10 m, or between about 10 m and about 20 m). In some embodiments, the length of the dewatering system is greater than or equal to about 0.5 m, greater than or equal to about 1 m, greater than or equal to about 2 m, greater than or equal to about 4 m, greater than or equal to about 6 m, greater than or equal to about 8 m, greater than or equal to about 10 m, or greater than or equal to about 15 m. In certain embodiments, the length of the dewatering system is less than about 20 m, less than about 15 m, less than about 10 m, less than about 8 m, less than about 6 m, or less than about 4 m. Other lengths are also possible. Combinations of the above-noted lengths are also possible (e.g., a length greater than or equal to about 2 m and less than about 6 m).

It should be appreciated that the components in system 140 of FIG. 2 are not limiting and that in some embodiments, certain components shown in the figure need not be present in a system, and in other embodiments, other components may optionally be present. For example, although system 140 as shown does not include a lamella, in other embodiments one or more lamellas may be present, e.g., for forming fiber webs including multiple layers.

As described herein, in some embodiments, by extending the length of the top surface and/or the length of the fiber web forming zone(s), the fiber mixture may contain a relatively higher amount of liquid as it exits downstream end 125 of the top surface. Accordingly, it may take a relatively longer time for the fiber web to include a relatively high percentage of solids, and the fiber web may only reach a relatively high percentage of solids after additional liquid has been removed further downstream of the downstream end of the top surface. For embodiments in which two or more fiber mixtures are combined to form a multi-layered fiber web, a relatively longer time to obtain a certain percentage of solids means that there may be more time for components in the fiber mixture to intermix. As such, the system may facilitate, in some embodiments, the formation of a fiber web having one or more gradients across all or portions of the thickness of the fiber web. In certain embodiments, such a system can be operated at higher pressures in the forming zone, thus allowing the formation of fiber webs at higher throughputs.

A fiber mixture as it exits the downstream end of the top surface may include any suitable wt % solids. In some cases, the wt % solids may be, for example, between about 1 wt % and about 35 wt % (e.g., between about 1 wt % and about 34 wt %, between about 1 wt % and about 30 wt %, between about 1 wt % and about 27 wt %, between about 5 wt % and about 27 wt %, between about 5 wt % and about 26 wt %, between about 5 wt % and about 25 wt %, between about 5 wt % and about 24 wt %, between about 15% and about 27 wt %, between about 5 wt % and about 20 wt %, between about 5 wt % and about 18 wt %, between about 7 wt % and about 17 wt %, between about 5 wt % and about 16 wt %, or between about 5 wt % and about 15 wt %). In certain embodiments, the fiber mixture may have less than about 35 wt % solids, less than about 34 wt % solids, less than about 32 wt % solids, less than about 30 wt % solids, less than about 28 wt % solids, less than about 27 wt % solids, less than about 26 wt % solids, less than about 25 wt % solids, less than about 24 wt % solids, less than about 23 wt % solids, less than about 20 wt % solids, less than about 18 wt % solids, less than about 17 wt % solids, less than about 16 wt % solids, less than about 15 wt % solids, less than about 14 wt % solids, less than about 10 wt % solids, or less than about 5 wt % solids. Other wt % solids are also possible. The wt % solids of the fiber mixture may be determined at the exit of the downstream end of the top lip using a beta gauge (or a gamma gauge).

In some embodiments, the throughput of fiber web formation using a system described herein may be varied. The throughput, i.e., the length of fiber web formed per unit time, may be, for example, between about 80 m of fiber web/min and about 500 m of fiber web/min (e.g., between about 80 m/min and about 100 m/min, between about 100 m/min and about 150 m/min, between about 150 m/min and about 500 m/min, between about 150 m/min and about 300 m/min, between about 200 m/min and about 500 m/min). The throughput of fiber web formation may be, for example, greater than about 80 m/min, greater than about 100 m/min, greater than about 150 m/min, greater than about 160 m/min, greater than about 175 m/min, greater than about 200 m/min, greater than about 300 m/min, or greater than about 400 m/min. In certain embodiments, the throughput of fiber web formation may be, for example, less than about 500 m/min, less than about 400 m/min, less than about 300 m/min, less than about 200 m/min, less than about 150 m/min, or less than about 100 m/min. Other throughputs are also possible. The throughput may be measured at a downstream end of the system (e.g., downstream of the dewatering system(s)) using a beta gauge (or a gamma gauge).

In some embodiments, the formation of fiber webs at the throughputs described above can be achieved without the fiber webs losing certain desired structural and/or performance characteristics. For instance, in one set of embodiments, the formation of fiber webs at the throughputs described above can be achieved while maintaining the ability to form fiber webs having a certain pressure drop across the resulting fiber web. The pressure drop across the fiber web may be, for example, between about 0.5 mm $H_2O$ and about 200 mm $H_2O$ (e.g., between about 0.5 mm $H_2O$ and about 10 mm $H_2O$, between about 10 mm $H_2O$ and about 200 mm $H_2O$, between about 10 mm $H_2O$ and about 50 mm $H_2O$, between about 50 mm $H_2O$ and about 200 mm $H_2O$). In certain embodiments, the pressure drop across a fiber web may be greater than about 1 mm $H_2O$, greater than about 10 mm $H_2O$, greater than about 20 mm $H_2O$, greater than about 50 mm $H_2O$, greater than about 75 mm $H_2O$, greater than about 100 mm $H_2O$, greater than about 125 mm $H_2O$, greater than about 150 mm $H_2O$, or greater than about 175 mm $H_2O$ at the throughputs described above. Other values of pressure drops are also possible.

The pressure drop is measured as the differential pressure across the fiber web when exposed to a face velocity of approximately 5.3 centimeters per second (corrected for standard conditions of temperature and pressure). The face velocity is the velocity of air as it hits the upstream side of the fiber web. Values of pressure drop are typically recorded as millimeters of water or Pascals. The values of pressure drop described herein may be determined according to British Standard BS6410:1991 using any suitable instrument, such as a TDA100P Penetrometer. For instance, using this test, pressure drop is measured by subjecting the upstream face of a fiber web to an airflow of 32 L/min over a 100 $cm^2$ face area of the fiber web, giving a media face velocity of 5.3 cm/s.

As shown illustratively in FIG. 2, system 140 may include a top surface 106 and a bottom surface (which includes bottom surface portion 100, apron 78, and forming wire 76). In some embodiments, the top surface may include a joint or a pivoting member 142 attached thereto. Optionally, in certain embodiments in which a pivoting member is included, the pivoting member and/or the top surface may be connected to a control system for varying the angle of the pivoting member, as described in more detail below. The pivoting member may allow extension 145 to be pivotally attached to another portion of the top surface, and may allow the extension to rotate about the pivoting member. Such rotation can change the distance (e.g., distance 150) between the downstream end of the top surface and the bottom surface, thereby increasing or decreasing the pressure of the fiber mixture(s) in fiber web forming zone 71A. An increase or decrease in pressure of the fiber mixture may also influence the throughput of fiber web formation, with higher pressures of fiber mixtures leading to an increase in throughput and lower pressures leading to a decrease in throughput.

When extension 145 is in a first position as shown in FIG. 2, the distance between the downstream end of the top surface and the forming wire is small, leading to high pressures in the fiber web forming zone. When extension 145 is in a second position 146, the distance between the downstream end of the top surface and the forming wire is relatively larger, leading to relatively lower pressures in the fiber web forming zone compared to when the extension is in the first position. When extension 145 is in a third position 148, the effect of the extension may be negligible and the pressure in the fiber web forming zone may be determined by distance 152. Accordingly, in some embodiments described herein including an extension having a variable position, a single system for forming a fiber web can be used for forming fiber webs at various pressures and throughputs.

It should be appreciated that in other embodiments, a top surface need not include a pivoting member. For example, the top surface may simply be extended in length to include extension 145. In certain embodiments, extension 145 of the top surface may be removably attached to another portion of the top surface. Thus, modification of a system for forming a fiber web may involve removing or adding the extension to the top surface (e.g., after ceasing flow of the fiber mixture(s)). In yet other embodiments, extension 145 may be irreversibly attached to the top surface. Other configurations are also possible.

A downstream-most portion of a top surface (e.g., extension 145) may be adjusted to have any suitable angle with respect to the horizontal (e.g., measured from an upstream joint or a pivoting member). In some cases, a downstream-most portion of a top surface may be adjusted to have an angle of between 0° and 180° above or below the horizontal (e.g., where the top surface portion is folded against another top surface portion at 180°). In some cases, the downstream-most portion of a top surface may be adjusted to have an angle of between 0° and 90°, between 0° and 45°, between 0° and 30°, between 0° and 20°, between 0° and 15°, or between 0° and 5° above or below the horizontal. For example, a downstream-most portion of a top surface may be positioned at an angle of greater than or equal to 5°, greater than or equal to 10°, greater than or equal to 15°, greater than or equal to 20°, greater than or equal to 25°, greater than or equal to 30°, greater than or equal to 35°, greater than or equal to 40°, greater than or equal to 45°, greater than or equal to 50°, greater than or equal to 60°, greater than or equal to 70°, greater than or equal to 80°, greater than or equal to 90°, or greater than or equal to 100° above or below the horizontal. Other angles are also possible.

In some instances in which the angle of the downstream-most portion of a top surface is adjusted from a first position to a second position, the differences between the first and second positions may be greater than or equal to 2°, greater than or equal to 5°, greater than or equal to 10°, greater than or equal to 15°, greater than or equal to 20°, greater than or equal to 25°, greater than or equal to 30°, greater than or equal to 35°, greater than or equal to 40°, greater than or equal to 45°, greater than or equal to 50°, greater than or equal to 60°, greater than or equal to 70°, greater than or equal to 80°, or greater than or equal to 90°. Other differences are also possible.

In some embodiments, a downstream end of a top surface is adjusted so that the distance between the downstream end of the top surface and a bottom surface (e.g., distance 150) is between about 1 mm and about 50 mm (e.g., between about 1 mm and about 5 mm, between about 5 mm and about 10 mm, between about 10 mm and about 20 mm, or between about 20 mm and about 50 mm). The distance between the downstream end of a top surface and the bottom surface may be, for example, greater than or equal to about 1 mm, greater than or equal to about 5 mm, greater than or equal to about 10 mm, greater than or equal to about 20 mm, or greater than or equal to about 40 mm. In other embodiments, the distance between the downstream end of a top surface and the bottom surface may be, for example, less than about 50 mm, less than about 40 mm, less than about 20 mm, less than about 10 mm, less than about 5 mm, less than about 4 mm, or less than about 3 mm. The distance is typically measured normal to the bottom surface, as shown in FIG. 2. Other distances are also possible.

As described herein, in some embodiments a top surface includes a pivoting member that may join two top surface portions. A variety of pivoting members can be used to control the position of a top surface portion. For example, in one embodiment a hinge can be used. In another embodiment, a pivoting member includes an adjustment wheel (e.g., gear wheel). In certain embodiments, a pivoting member is connected to a motor (e.g., an electric motor) which can allow adjustments of the angle of the top surface portion. For example, in some embodiments, a pivoting member may comprise a rotating cam. In other embodiments, a servomechanism can be used. In certain embodiments, mechanical, electromechanical, hydraulic, pneumatic or magnetic systems can be used to control a position. All or portions of the control mechanism may extend outside of the flow zone in some embodiments, and may be either manually or automatically controlled. Combinations of mechanisms and/or control systems can also be used. Other mechanisms and configurations for controlling the angle of a top surface portion are also possible.

In some embodiments, a control system is used to vary the distance between the downstream end of a top surface portion and a bottom surface (e.g., distance 150), and/or the distance between an intermediate surface portion and a bottom surface (e.g., distance 152). In some instances, the control system may be connected to a pivoting member for varying the angle of a top surface portion. In some embodiments, a top surface portion and/or a pivoting member may be electronically connected to a control system. Adjustments of the distance between a top surface portion and a bottom surface may be controlled by the control system and may take place automatically by, for example, an automated control system and/or may be controlled by input from a user. In some embodiments, instructions for adjusting the position of a top surface portion are pre-programmed into the control system, e.g., prior to initiating a production run. The one or more control systems can be implemented in numerous ways, such as with dedicated hardware and/or firmware, using a processor that is programmed using microcode or software to perform the functions described herein. In some embodiments, control of the distance between a top surface portion and a bottom surface involves the use of sensors and/or positive or negative feedback (e.g., using a servomechanism). A control system can be used to adjust the distance of several top surface portions (e.g., simultaneously or alternately) in some embodiments.

Where the distances between more than one top surface portions and a bottom surface are adjustable, each of the distances may be controlled independently of one another. For instance, the distances may be controlled independently such that each of the distances can change depending on the location of the top surface portion in the flow zone or fiber web forming zone, the amount of fluid and/or pressure in the flow zone or fiber web forming zone, the type of fiber mixture(s) in the system, the amount of turbulence desired, and/or other conditions.

According to one set of embodiments, the distance between a top surface portion and a bottom surface may be varied while one or more fiber mixtures is flowing in the flow zone or fiber web forming zone. The distance may include, for example, the distance between a downstream end of the top surface and a bottom surface (e.g., distance 150 shown in FIG. 2) or an intermediate portion of the top surface and a bottom surface (e.g., distance 152 shown in FIG. 2). In certain embodiments, the angle of a top surface portion can be varied while one or more fiber mixtures is flowing in the flow zone or fiber web forming zone. The change in distance between a top surface portion and a bottom surface, or the change in angle of a top surface portion, may vary the flow profile of one or more fiber mixtures flowing in the flow zone and/or fiber web forming zone, and may affect the degree of mixing between fiber mixtures. Advantageously, in some embodiments, such a processes can be used to form different fiber webs having different properties without ceasing fluid flow and/or without stopping a production run. A production run typically involves setting parameters of the system to form a fiber web having a particular set of properties. A first production run may involve, for example, forming a first fiber web having a particular set of properties using a top surface portion in a first position. Then (e.g., without stopping flow of the fiber mixtures), the position of the top surface portion may be changed to a second position suitable for forming a second fiber web having a particular set of properties different from the first fiber web. In some embodiments, these steps may be performed on a continuous basis, e.g., with an automated positioning device. Optionally, a different fiber mixture (e.g., a third fiber mixture) may be introduced into the flow zone before, during, or after changing the distance between a top surface portion and a bottom surface, or the angle of a top surface portion.

In other embodiments, adjusting the position and/or configuration of a top surface may be performed on a discontinuous basis, e.g., by shutting down the system, manually (or automatically) adjusting the position of a top surface portion, and restarting the production run. In certain embodiments, the distance between a top surface portion and a bottom surface, or the angle of a top surface portion, may be changed before or after a production run. For instance, a first production run may involve using a top surface portion in a first position. The first production run may be ceased (e.g., ceasing flow of the fiber mixtures), and then the position of the top surface portion may be changed to a second position. A second production run can then be initiated while the top surface portion is in the second position.

As described herein, in some embodiments, the systems shown in FIGS. 1 and 2 can be used to form a fiber web including two or more layers, e.g., using first and second fiber mixtures. In some embodiments, it is desirable to reduce or limit the amount of mixing between the first and second fiber mixtures at or near the fiber web forming zone. Typically, the fiber mixtures are flowed laminarly in the flow zone to achieve limited amounts of mixing. In other embodiments, it is desirable to promote larger amounts of mixing between the first and second fiber mixtures at or near the fiber web forming zone. In such embodiments, the flow of a fiber mixture in at least a portion of the flow zone may be non-laminar (e.g., turbulent). The degree of mixing of the first and second fiber mixtures may control the presence, absence, and/or type of gradient in the resulting fiber web, as described in more detail herein.

Laminar flow is generally characterized by the flow of a fluid having a relatively low Reynolds number. In some embodiments, flow of a fiber mixture in at least a portion of a flow zone is laminar and may have a Reynolds number of, for example, less than about 2,300, less than about 2,100, less than about 1,800, less than about 1,500, less than about 1,200, less than about 900, less than about 700, or less than about 400. The Reynolds number may have a range from, for example, between about 2,300 and about 100. Other values and ranges of Reynolds numbers are also possible.

In some embodiments, the flow of a fiber mixture in at least a portion of a flow zone is non-laminar (e.g., turbulent), and may have a Reynolds number that is greater than about 2,100, greater than about 2,300, greater than about 3,000, greater than about 5,000, greater than about 10,000, greater than about 13,000, or greater than about 17,000. The Reynolds number may have a range from, for example, between about 2,100 and about 20,000. Other values and ranges of Reynolds numbers are also possible.

The flow of a fiber mixture may also have a Reynolds number at the transition between laminar and turbulent flow (e.g., between about 2,100 and about 4,000). Other values and ranges of Reynolds numbers are also possible. Those of ordinary skill in the art can vary the Reynolds number of a flow by, for example, altering the flow velocity of the fiber mixture, viscosity of the fiber mixture, density of the fiber mixture, and/or the dimensions of the flow zone using known methods in combination with the description provided herein.

The degree of mixing of the first and second fiber mixtures can be controlled by varying different parameters. Examples of parameters that can be varied to control the level of mixing between fiber mixtures include, but are not limited to, the magnitude of the flow velocities of the fiber mixtures flowing in the flow zone, the relative difference in flow velocities between fiber mixtures flowing in the lower and upper portions of the flow zone, the flow profile of the fiber mixtures flowing in the lower and upper portions of the flow zone (e.g., laminar flow or turbulent flow), the volume of the flow zone (including the relative volumes of the lower and upper portions of the flow zone), the length of the lamella, the size and length of the forming zone, the length of the top surface, the size and length of the dewatering system, the level of vacuum used (if any) in the dewatering system, the throughput of fiber web formation, the density of the fiber mixtures (including the difference in densities of the fiber mixtures in the lower and upper portions of the flow zone), the particular chemistry of the fiber mixtures (e.g., pH, presence/absence of particular viscosity modifiers) including the difference in chemistry of the fiber mixtures in the lower and upper portions of the flow zone, and the sizes (e.g., lengths, diameters) of the fibers in the fiber mixtures. In certain embodiments described herein, one or more of such parameters are varied to control the degree of mixing between fiber mixtures.

In some embodiments, the flow velocity of a fiber mixture and/or the degree of mixing between fiber mixtures in a flow zone may be varied using a system or method described in U.S. application Ser. No. 13/469,352, filed May 11, 2012 and entitled "Systems and Methods for Making Fiber Webs" and/or U.S. application Ser. No. 13/469,373, filed May 11, 2012 and entitled "Systems and Methods for Making Fiber Webs", each of which is incorporated herein by reference in its entirety for all purposes.

As described herein, in some embodiments, at least some mixing between fiber mixtures is desired at or near the fiber web forming zone to create a gradient in one or more properties in a fiber web. Intermixing between fiber mixtures may be produced, in some embodiments, by creating turbulent flow at or near the downstream end of the lamella where two fiber mixtures meet (e.g., at or near the fiber web forming zone). Turbulent flow at or near the downstream end of the lamella may be promoted by, for example, disrupting laminar flow in one or more regions of the flow zone. For example, in some cases laminar flow is disrupted in the lower portion of the flow zone such that the fiber mixture in that portion, upon reaching the downstream end of the lamella, interjects into at least a part of the fiber mixture above it. Eddies may be formed that cause mixing of the fiber mixtures at the fluid interface between the mixtures. Likewise, intermixing can be produced by disrupting laminar flow in an upper portion of the flow zone such that, upon the fiber mixture in the upper portion reaching the downstream end of the lamella, at least a part of the fiber mixture interjects into the fiber mixture below it. In other embodiments, laminar flow in both the upper and lower portions of the flow zone can promote intermixing of the fiber mixtures at or near the fiber web forming zone.

In general, a fiber mixture may have any suitable flow velocity. As described herein, the flow velocity of a fiber mixture may vary in a portion of flow zone (e.g., in a lower or upper portion of the flow zone) and/or a fiber web forming zone, e.g., as shown in any of the figures. In some embodiments, the flow velocity of a fiber mixture varies between about 1 m/min to about 1,000 m/min (e.g., between about 1 m/min to about 100 m/min, between about 10 m/min to about 50 m/min, between about 100 m/min to about 500 m/min, or between about 500 m/min to about 1,000 m/min), although other ranges are also possible. In some embodiments, the flow velocity of a fiber mixture may be greater than about 1 m/min, greater than about 10 m/min, greater than about 20 m/min, greater than about 30 m/min, greater than about 40 m/min, greater than about 50 m/min, greater than about 70 m/min, greater than about 100 m/min, greater than about 200 m/min, greater than about 300 m/min, greater than about 400 m/min, greater than about 600 m/min, greater than about 800 m/min, or greater than about 1,000 m/min. In other embodiments, the flow velocity of a fiber mixture may be less than about 1,800 m/min, less than about 1,500 m/min, less than about 1,000 m/min, less than about 800 m/min, less than about 600 m/min, less than about 500 m/min, less than about 400 m/min, less than about 300 m/min, less than about 200 m/min, less than about 150 m/min, less than about 100 m/min, less than about 80 m/min, less than about 70 m/min, less than about 50 m/min, less than about 40 m/min, less than about 30 m/min, less than about 20 m/min, or less than about 10 min/min. Combinations of the above-noted ranges are also possible (e.g., a flow velocity of greater than about 10 m/min and less than about 1,000 m/min). Other values of flow velocity are also possible.

Any suitable fiber mixture may be introduced into a system for forming a fiber web. A fiber mixture generally contains a mixture of at least one or more fibers and a solvent such as water. Examples of fibers include glass fibers, synthetic fibers, cellulose fibers, and binder fibers. The fibers may have various dimensions such as fiber diameters between about 0.1 microns and about 50 microns. The mixture may optionally contain one or more additives such as pH adjusting materials, viscosity modifiers, and surfactants.

The terms "first fiber mixture" and "second fiber mixture" as used herein generally refer to fiber mixtures flowing in different portions of a flow zone. It should be appreciated that while a first fiber mixture and a second fiber mixture may be different, in other embodiments the fiber mixtures may be the same. For example, in one set of embodiments, a first fiber mixture has the same composition as a second fiber mixture (e.g., a first fiber mixture may have the same types of components and the same concentration of components as those of a second fiber mixture). In other embodiments, a first fiber mixture has a different composition from that of a second fiber mixture (e.g., a first fiber mixture may have at least one different type of component and/or a different concentration of at least one component from that of a second fiber mixture). Types of components that may differ between fiber mixtures may include, for example, fiber type, fiber diameter, and additive type.

In one particular set of embodiments, a "first fiber" contained in the first fiber mixture may be the same as a "second fiber" contained in the second fiber mixture. In other embodiments, a "first fiber" contained in the first fiber mixture may be different from a "second fiber" contained in the second fiber mixture. First and second fiber mixtures may also differ in the presence and/or absence of one or more components relative to the other. Combinations of such differences and other configurations of first and second fiber mixtures are also possible. It can be appreciated that the description above with respect to first and second fiber mixtures also applies to additional fiber mixtures (e.g., a "third fiber mixture", a "fourth fiber mixture", etc.).

In some cases, a fiber mixture is processed prior to introduction into the flow zone of the system. For example, a fiber mixture may be prepared in one or more pulpers. After appropriately mixing the fiber mixture in a pulper, the mixture may be pumped into a flow distributor such as a headbox, where the fiber mixture may optionally be combined with other fiber mixtures or additives. The fiber mixture may also be diluted with additional water such that the final concentration of fiber is in a suitable range, such as for example, between about 0.01% to about 2% by weight (e.g., between about 0.1% to about 1% by weight, or between about 0.1% to about 0.5% by weight). Other concentrations are also possible.

Optionally, before the fiber mixture is sent to a flow distributor, the fiber mixture may be passed though centrifugal cleaners for removing contaminants or unwanted materials (e.g., unfiberized material used to form the fibers). The fiber mixture may be optionally passed through additional equipment such as a refiner or a deflaker to further enhance the dispersion of the fibers prior to their introduction into the flow zone. A fiber mixture may contain any suitable component for forming a fiber web. In some embodiments, a fiber mixture includes one or more glass fibers. The glass fibers may be, for example, microglass fibers or chopped strand glass fibers, which are known to those of ordinary skill in the art. The microglass fibers may have relatively small diameters such as less than about 10.0 microns (e.g., between about 0.1 microns and about 10.0 microns). Fine microglass fibers (e.g., fibers less than 1 micron in diameter) and/or coarse microglass fibers (e.g., fibers greater than or equal to 1 micron in diameter) may be used. The aspect ratios (length to diameter ratio) of the microglass fibers may be generally in the range of about 100 to 10,000. Chopped strand glass fibers may have diameters of, for example, between about 5 microns and about 30 microns, and lengths in the range of between about 0.125 inches and about 1 inch. Other dimensions of glass fibers are also possible.

In some embodiments, a fiber mixture includes one or more synthetic fibers. Synthetic fibers may be, for example, binder fibers, bicomponent fibers (e.g., bicomponent binder fibers) and/or staple fibers. In general, the synthetic fibers may have any suitable composition. Non-limiting examples of synthetic fibers include PVA (polyvinyl alcohol), aramides, polytetrafluoroethylenes, polyesters, polyethylenes, polypropylenes, acrylic resins, polyolefins, polyamides, polystyrene, nylon, rayon, polyurethanes, cellulosic or regenerated cellulosic resins, copolymers of the above materials, and combinations thereof. It should be appreciated that other suitable synthetic fibers may also be used. Synthetic fibers may have fiber diameters ranging from, for example, between about 5 microns and about 50 microns. Other dimensions of synthetic fibers are also possible.

In one set of embodiments, a fiber mixture includes one or more binder fibers (e.g., PVA binder fibers). Binder fibers may have fiber diameters ranging from, for example, between about 5 microns and about 50 microns. Other dimensions of binder fibers are also possible.

In one set of embodiments, a fiber mixture includes one or more bicomponent fibers. The bicomponent fibers may comprise a thermoplastic polymer. Each component of the bicomponent fiber can have a different melting temperature. For example, the fibers can include a core and a sheath where the activation temperature of the sheath is lower than the melting temperature of the core. This allows the sheath to melt prior to the core, such that the sheath binds to other fibers in the layer, while the core maintains its structural integrity. The core/sheath binder fibers can be concentric or non-concentric. Other exemplary bicomponent fibers can include split fiber fibers, side-by-side fibers, and/or "island in the sea" fibers. Bicomponent fibers may have fiber diameters ranging from, for example, between about 5 microns and about 50 microns. Other dimensions of bicomponent fibers are also possible.

In another set of embodiments, a fiber mixture includes one or more cellulose fibers (e.g., wood pulp fibers). Suitable cellulose fiber compositions include softwood fibers, hardwood fibers and combinations thereof. Examples of softwood cellulose fibers include fibers that are derived from the wood of pine, cedar, alpine fir, douglas fir, and spruce trees. Examples of hardwood cellulose fibers include fibers derived from the wood of eucalyptus (e.g., Grandis), maple, birch, and other deciduous trees. Cellulose fibers may have fiber diameters ranging from, for example, between about 5 microns and about 50 microns. Other dimensions of cellulose fibers are also possible.

Figure 3:
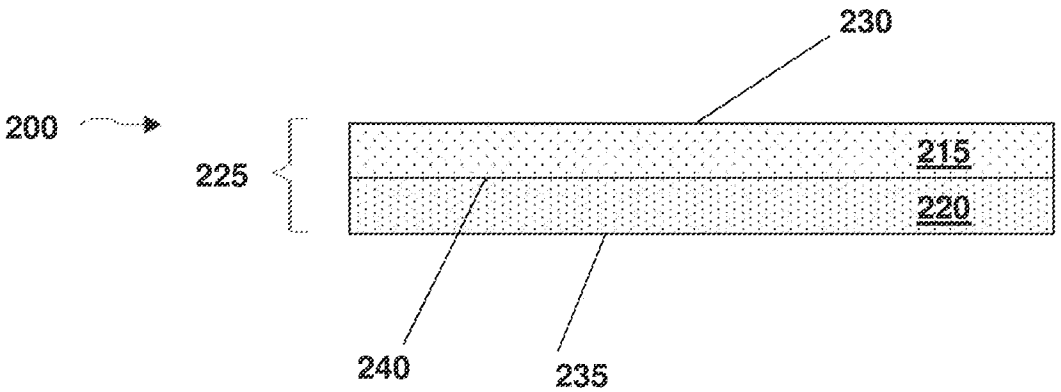
FIG. 3 is a schematic diagram showing a fiber web according to one set of embodiments.

The methods and systems described herein can be used to form fiber webs having a single layer, or multiple layers. In some embodiments involving multiple layers, a clear demarcation of layers may not always be apparent. An example of a fiber web that can be formed using the methods and systems described herein is shown in FIG. 3. As shown illustratively in FIG. 3, a fiber web 200 includes a first layer 215 and a second layer 220. The first layer may be formed from a first fiber mixture and the second layer may be formed from a second fiber mixture, as described herein. Optionally, the fiber web may include additional layers (not shown). Fiber web 200 may be non-woven.

In some embodiments, fiber web 200 includes a gradient (i.e., a change) in one or more properties such as fiber diameter, fiber type, fiber composition, fiber length, fiber surface chemistry, pore size, material density, basis weight, solidity, a proportion of a component (e.g., a binder, resin, crosslinker), stiffness, tensile strength, wicking ability, hydrophilicity/hydrophobicity, and conductivity across a portion, or all of, a thickness 225 of the fiber web. Fiber webs suitable for use as filter media may optionally include a gradient in one or more performance characteristics such as efficiency, dust holding capacity, pressure drop, air permeability, and porosity across the thickness of the fiber web. A gradient in one or more such properties may be present in the fiber web between a top surface 230 and a bottom surface 235 of the fiber web.

Different types and configurations of gradients are possible within a fiber web. In some embodiments, a gradient in one or more properties is gradual (e.g., linear, curvilinear) between a top surface and a bottom surface of the fiber web. For example, the fiber web may have an increasing basis weight from the top surface to the bottom surface of the fiber web. In another embodiment, a fiber web may include a step gradient in one more properties across the thickness of the fiber web. In one such embodiment, the transition in the property may occur primarily at an interface 240 between the two layers. For example, a fiber web, e.g., having a first layer including a first fiber type and a second layer including a second fiber type, may have an abrupt transition between fiber types across the interface. In other words, each of the layers of the fiber web may be relatively distinct. In other embodiments, a gradient is characterized by a type of function across the thickness of the fiber web. For example a gradient may be characterized by a sine function, a quadratic function, a periodic function, an aperiodic function, a continuous function, or a logarithmic function across the web. Other types of gradients are also possible.

In certain embodiments, a fiber web may include a gradient in one or more properties through portions of the thickness of the fiber web. In the portions of the fiber web where the gradient in the property is not present, the property may be substantially constant through that portion of the web. As described herein, in some instances a gradient in a property involves different proportions of a component (e.g., a fiber, an additive, a binder) across the thickness of a fiber web. In some embodiments, a component may be present at an amount or a concentration that is different than another portion of the fiber web. In other embodiments, a component is present in one portion of the fiber web, but is absent in another portion of the fiber web. Other configurations are also possible.

In some embodiments, a fiber web has a gradient in one or more properties in two or more regions of the fiber web. For example, a fiber web having three layers may have a first gradient in one property across the first and second layer, and a second gradient in another property across the second and third layers. The first and second gradients may be different in some embodiments (e.g., characterized by a different function across the thickness of the fiber web), or may be the same in other embodiments. Other configurations are also possible.

A fiber web may include any suitable number of layers, e.g., at least 2, 3, 4, 5, 6, 7, 8, or 9 layers, or may be formed using any suitable number of fiber mixtures, e.g., at least 2, 3, 4, 5, 6, 7, 8, or 9 fiber mixtures, depending on the particular application and performance characteristics desired. It should be appreciated that in some embodiments, the layers forming a fiber web may be indistinguishable from one another across the thickness of the fiber web. As such, a fiber web formed from, for example, two "layers" or two "fiber mixtures" can also be characterized as having a single "layer" having a gradient in a property across the fiber web in some instances.

Examples of multi-layered fiber webs are disclosed in U.S. Patent Publication No. 2010/0116138, filed Jun. 19, 2009, entitled "Multi-Phase Filter Medium", which is incorporated herein by reference in its entirety for all purposes.

During or after formation of a fiber web, the fiber web may be further processed according to a variety of known techniques. Optionally, additional layers can be formed and/or added to a fiber web using processes such as lamination, co-pleating, or collation. For example, in some cases, two layers are formed into a composite article by a wet laid process as described above, and the composite article is then combined with a third layer by any suitable process (e.g., lamination, co-pleating, or collation). It can be appreciated that a fiber web or a composite article formed by the processes described herein may be suitably tailored not only based on the components of each fiber layer, but also according to the effect of using multiple fiber layers of varying properties in appropriate combination to form fiber webs having the characteristics described herein.

In some embodiments, further processing may involve pleating the fiber web. For instance, two layers may be joined by a co-pleating process. In some cases, the fiber web, or various layers thereof, may be suitably pleated by forming score lines at appropriately spaced distances apart from one another, allowing the fiber web to be folded. It should be appreciated that any suitable pleating technique may be used.

It should be appreciated that the fiber web may include other parts in addition to the one or more layers described herein. In some embodiments, further processing includes incorporation of one or more structural features and/or stiffening elements. For instance, the fiber web may be combined with additional structural features such as polymeric and/or metallic meshes. In one embodiment, a screen backing may be disposed on the fiber web, providing for further stiffness. In some cases, a screen backing may aid in retaining the pleated configuration. For example, a screen backing may be an expanded metal wire or an extruded plastic mesh.

In some embodiments, fiber webs used as filter media can be incorporated into a variety of filter elements for use in various filtering applications. Exemplary types of filters include hydraulic mobile filters, hydraulic industrial filters, fuel filters (e.g., automotive fuel filters), oil filters (e.g., lube oil filters or heavy duty lube oil filters), chemical processing filters, industrial processing filters, medical filters (e.g., filters for blood), air filters, and water filters. In some cases, filter media described herein can be used as coalescer filter media. The filter media may be suitable for filtering gases or liquids.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of forming a fiber web, comprising:

introducing a fiber mixture into a flow zone of a system for forming a fiber web, wherein the system comprises a fiber web forming zone positioned downstream of the flow zone, and wherein the system includes a pressure former comprising a top surface and a pivoting member connected to a portion of the top surface within the fiber web forming zone;

collecting fibers from the fiber mixture downstream of the flow zone in the fiber web forming zone, wherein the fiber web forming zone comprises a forming wire portion; and forming a fiber web comprising fibers from the fiber mixture.

2. The method of claim 1, wherein the system comprises a control system connected to the top surface and/or the pivoting member for controlling a distance between a downstream end of the top surface and at least a portion of the forming wire portion.

3. The method of claim 1, comprising adjusting the angle of the top surface to change a distance between a downstream end of the top surface and at least a portion of the forming wire portion.

4. The method of claim 1, wherein the fiber web forming zone is a first fiber web forming zone, the method comprising transporting the fibers to a second fiber web forming zone positioned downstream of the first fiber web forming zone, wherein the second fiber web forming zone comprises a second forming wire portion.

5. The method of claim 4, comprising a first dewatering system positioned at the first fiber web forming zone.

6. The method of claim 5, comprising a second dewatering system positioned at the second fiber web forming zone.

7. The method of claim 6, wherein the second dewatering system is positioned below the second forming wire portion.

8. The method of claim 6, wherein the second dewatering system is positioned above the second forming wire portion.

9. The method of claim 6, wherein the first and/or second dewatering systems comprises one or more vacuum boxes.

10. The method of claim 6, comprising using the second dewatering system to reorient fibers from the fiber web from a first orientation to a second orientation.

11. The method of claim 4, wherein the fibers in the fiber mixture, as the fiber mixture exits a downstream end of the top surface, have a first orientation, and the fibers in the fiber mixture at the second forming wire portion have a second orientation, and wherein the first orientation is different from the second orientation.

12. The method of claim 11, wherein the second orientation comprises greater intermixing between two different fibers compared to the first orientation.

13. The method of claim 1, comprising forming a fiber mixture having a solid content of less than about 28 wt % as the fiber mixture exits a downstream end of the top surface.

14. The method of claim 1, wherein the system comprises a first flow distributor configured to dispense a first fiber mixture into the flow zone, and a second flow distributor configured to dispense a second fiber mixture into the flow zone.

15. The method of claim 1, wherein a distance between a downstream end of the top surface and the forming wire portion is less than about 10 mm.

16. The method of claim 1, wherein the system comprises a lamella positioned in the flow zone to separate the flow zone into a lower portion and an upper portion.

17. The method of claim 1, comprising forming a fiber web comprising a gradient in at least one of fiber diameter, fiber type, fiber composition, fiber length, fiber surface chemistry, pore size, material density, basis weight, solidity, a proportion of a component, stiffness, tensile strength, wicking ability, hydrophilicity/hydrophobicity, and conductivity across a portion, or all, of a thickness of the fiber web.

18. The method of claim 1, comprising forming a fiber web comprising a gradient in at least one of efficiency, dust holding capacity, pressure drop, air permeability, and porosity across a portion, or all, of a thickness of the fiber web.

19. The method of claim 1, wherein the pivoting member is connected to a portion of the top surface at a downstream end of the fiber web forming zone.

20. The method of claim 1, wherein the pivoting member connects a downstream portion of the top surface with an extension of the top surface.

* * * * *